US007061832B1

(12) United States Patent
Lansing

(10) Patent No.: US 7,061,832 B1
(45) Date of Patent: Jun. 13, 2006

(54) BABY BOTTLE TIMER

(76) Inventor: Robert F. Lansing, 1 Faith La., Manchester, NH (US) 03104

( * ) Notice: Subject to any disclaimer, the term of this patent is extended or adjusted under 35 U.S.C. 154(b) by 0 days.

(21) Appl. No.: 10/904,907

(22) Filed: Dec. 3, 2004

(51) Int. Cl.
*G04C 17/00* (2006.01)
*G04F 10/00* (2006.01)

(52) U.S. Cl. ..... 368/10; 368/108; 368/242

(58) Field of Classification Search ..... 368/10, 368/89, 223, 241, 242, 83, 82, 276, 277, 368/281, 282
See application file for complete search history.

(56) References Cited

U.S. PATENT DOCUMENTS

| | | | | |
|---|---|---|---|---|
| 3,658,122 | A | 4/1972 | Kalyk | |
| 4,361,408 | A * | 11/1982 | Wirtschafter | 368/10 |
| 4,448,541 | A * | 5/1984 | Wirtschafter | 368/10 |
| 4,849,948 | A * | 7/1989 | Davis et al. | 368/10 |
| 4,860,684 | A | 8/1989 | Al-Harbi | |
| 5,797,313 | A | 8/1998 | Rothley | |
| 5,808,276 | A | 9/1998 | Padilla | |
| 6,037,872 | A | 3/2000 | Dunnum | |
| 6,104,292 | A | 8/2000 | Rombom et al. | |
| 6,571,564 | B1 | 6/2003 | Upadhye et al. | |
| 2003/0074903 | A1 | 4/2003 | Upadhye et al. | |
| 2004/0140304 | A1 | 7/2004 | Leyendecker | |
| 2004/0168684 | A1 | 9/2004 | Shapiro et al. | |

FOREIGN PATENT DOCUMENTS

| | | |
|---|---|---|
| EP | 1 153 562 A2 | 11/2001 |
| WO | WO 02/15142 A1 | 2/2002 |

* cited by examiner

*Primary Examiner*—Kamand Cuneo
*Assistant Examiner*—Jeanne-Marguerite Goodwin
(74) *Attorney, Agent, or Firm*—Robert R Deleault, Esq; Mesmer & Deleault, PLLC

(57) ABSTRACT

A baby bottle timer includes a timer configured to have a maximum two-hour time period and an adjustable band attached to the timer and configured to removably attach the baby bottle timer to a baby bottle. The timer has a switch mechanism and a display with changeable indicia displaying an initial indicia at the beginning of the time period and a different indicia at the end of the time period.

20 Claims, 5 Drawing Sheets

BABY BOTTLE TIMER

BACKGROUND OF THE INVENTION

1. Field of the Invention

The present invention relates generally to baby bottles. Particularly, the present invention relates to the use of formula/milk in a baby bottle. More particularly, the present invention relates to a timer that indicates the useful life of the formula/milk in a baby bottle.

2. Description of the Prior Art

Many healthcare professionals believe that breastfeeding is preferable to bottle feeding for most babies. Breastfeeding may not be possible or preferable for all mothers. For these mothers the alternative requires bottle feeding their baby-stored breast milk or formula. Formula, like milk, is subject to rapid spoilage at room temperature. Spoilage is even more rapid when the milk or formula is heated because heat speeds up the chemical reactions that bring about degradation. For this reason, formula and milk have a short useful life outside of a refrigerator and should be discarded after a few hours.

Baby bottle or baby feeding related devices in the prior art typically relate to feeding times, formula preparation, formula heating and/or cooling, etc. Some of these devices are disclosed below.

U.S. Pat. No. 4,860,684 (1989, Al-Harbi) discloses an infant bottle timer apparatus where an encircling indexed band is fixedly securable to an associated exterior surface of a baby bottle-type feeding implement. The timer apparatus includes a lowermost portion indexed consistent with the hours of the day and a pointer selectively manipulatable within an overlying integrally formed track for indication of a subsequent feeding time event. The track includes a channel capturing a leaf spring. The leaf spring is secured to and cooperates with the pointer which is of a generally "H" shaped cross-sectional configuration. A first pair of legs of the "H" shaped pointer is ridable within the channel and frictionally securable within the channel in cooperation with the leaf spring. A further pair of legs of the "H" shaped pointer is oriented exteriorly of the channel for indication of a subsequent feeding time event in cooperation with the indicator band. The indicator band is formed as an extension of a rear portion of the channel for providing a unitary compact structure in cooperative association with the baby bottle.

U.S. Pat. No. 6,571,564 (2003, Upadhye et al.) discloses an invention related to a warmer and cooler for a container that is programmably timed to engage a heating and/or cooling unit. The invention may be adapted for use with a baby bottle to facilitate nighttime feedings by programming when the unit should be turned on to heat the bottle or cool the bottle.

U.S. Patent Application Publication U.S. 2004/0140304 A1 (2004, Leyendecker) discloses a device for chilling and warming a baby bottle in a single chamber and a method of operating the device. The device typically utilizes a thermoelectric module to chill the chamber. The thermoelectric module can also be used to warm the chamber or a separate resistive heater may be provided. A clock circuit is utilized in certain embodiments that can be set to an activation or target time to automatically cause the device to switch from a chilling mode to a warming mode at the activation time.

U.S. Pat. No. 6,104,292 (2000, Rombom et al.) discloses a baby bottle attachment with sound monitor/transmitter and recordable/pre-recorded sound playback. The baby bottle attachment has a cylindrical housing containing electronic integrated circuitry that removably attaches to a baby bottle. The bottle attachment functions as a room monitor for monitoring the sounds of an infant, as an educational device that plays custom-recorded or pre-recorded educational messages and sounds, and as an amusement device that plays various sounds to educate and amuse the infant. The base unit may also contain a battery charger and an FM receiver for holding the bottle attachment, recharging its battery, and serving as a remote receiver for monitoring sounds transmitted by the bottle attachment when in use.

U.S. Pat. No. 6,037,872 (2000, Dunnum) discloses a baby bottle having removable handles and an automated sound producing means. The baby bottle includes one or more removably attached handles with an integral voice chip received therein. The integral voice chip is in communication with a mechanical thermostat received within an arcuate portion of the handle that is grasped by a user. Upon the thermostat sensing a preselected temperature, a pair of timer circuits in communication therewith activate the voice chip. When the thermostat detects a temperature below the predetermined value, the timer circuits disable the voice chip after a predetermined duration.

A major disadvantage of the prior art is that none of the prior art is capable of indicating how long a baby bottle containing formula, milk or other ingestible liquid has been exposed to ambient temperatures and ambient air. Formula and milk have a relatively short, safe, useful life of about one to about two hours because they are prone to relatively rapid spoilage at room temperature. In addition, uncertainty about the exposure time of the preheated formula to ambient air and to bacteria from the baby's mouth increases the risk that the formula may have become contaminated. This leads to either feeding the baby contaminated and/or spoiled formula or, in the alternative, discarding baby formula that may still be safe for the baby. Either option may have negative economic value to the user.

Therefore, what is needed is a bottle timer that indicates the useful life of the contents of a baby bottle. What is also needed is a bottle timer that prevents bottle mix up when more than one bottle has been prepared. What is further needed is a bottle timer that minimizes the risk of either feeding a baby spoiled formula or milk, or discarding usable formula or milk.

SUMMARY OF THE INVENTION

It is an object of the present invention to provide a bottle timer that indicates the useful life of the contents of the bottle. It is also an object of the present invention to provide a bottle timer that prevents bottle mix up when more than one bottle has been prepared. It is a further object of the present invention to provide a bottle timer that minimizes the likelihood of discarding wholesome, unspoiled, and uncontaminated baby bottle contents because the infant caregiver has forgotten how long the baby bottle contents have been exposed to ambient air.

The present invention achieves these and other objectives by providing a baby bottle timer having a timer configured to operate for a maximum two-hour time period and an adjustable band attached to the timer and configured to removably attach the baby bottle timer to a baby bottle. The timer has a switch mechanism and a display with changeable indicia displaying an initial indicia at the beginning of the time period and a different indicia at the end of the time period.

In one embodiment of the present invention, the baby bottle timer typically includes a digital battery operated timer that incorporates a digital display. The display preferably shows a time period of 120 to 0 minutes and, more preferably, a time period of 60 to 0 minutes.

In another embodiment the timer incorporates a green and red LED display. When the timer is actuated with the On button, a green LED display will appear and remain green until a preset safe time period has elapsed. At that time the green LED will turn off and the red LED will turn on, indicating that the formula is no longer safe for the infant. The red LED will remain on until it is turned off by actuating the Off button.

In yet another embodiment, the timer can be configured to include both a changeable indicia such as the colored LEDs and a digital display preferably showing a time period of 120 to 0 minutes, and, more preferably, a time period of 60 to 0 minutes. In this configuration, when the On button is actuated, the green LED turns on and the digital display starts to count down or up. The green LED will remain on until the timer has counted through the preset time period. At the end of the preset time period, the green LED turns off and the red LED turns on. When the Off button is actuated, the time period is reset and the LED's turn off. The bottle timer can be configured to count up or down to any desired time limit within the maximum two-hour time period.

In still another embodiment of the bottle timer, the electronic timer or mechanical timer projects a baby bottle that is green in its entirety when the timer is turned on. As the time cycle advances, the green bottle projection will fade away until the preset time period is reached. At that time, the projected baby bottle will turn red, indicating that the baby formula is no longer safe to give to the infant. This timer may be incorporated into the bottle or it may be a removably attachable base incorporating an electronic or mechanical timer that supports the bottle.

In a further embodiment, an electronic timer or mechanical timer is attached to and encircles the bottle with an adjustable type band or is configured as a housing with an inner adjustable ring designed to fit over most baby bottles.

DETAILED DESCRIPTION OF THE PREFERRED EMBODIMENT

Figure 1:
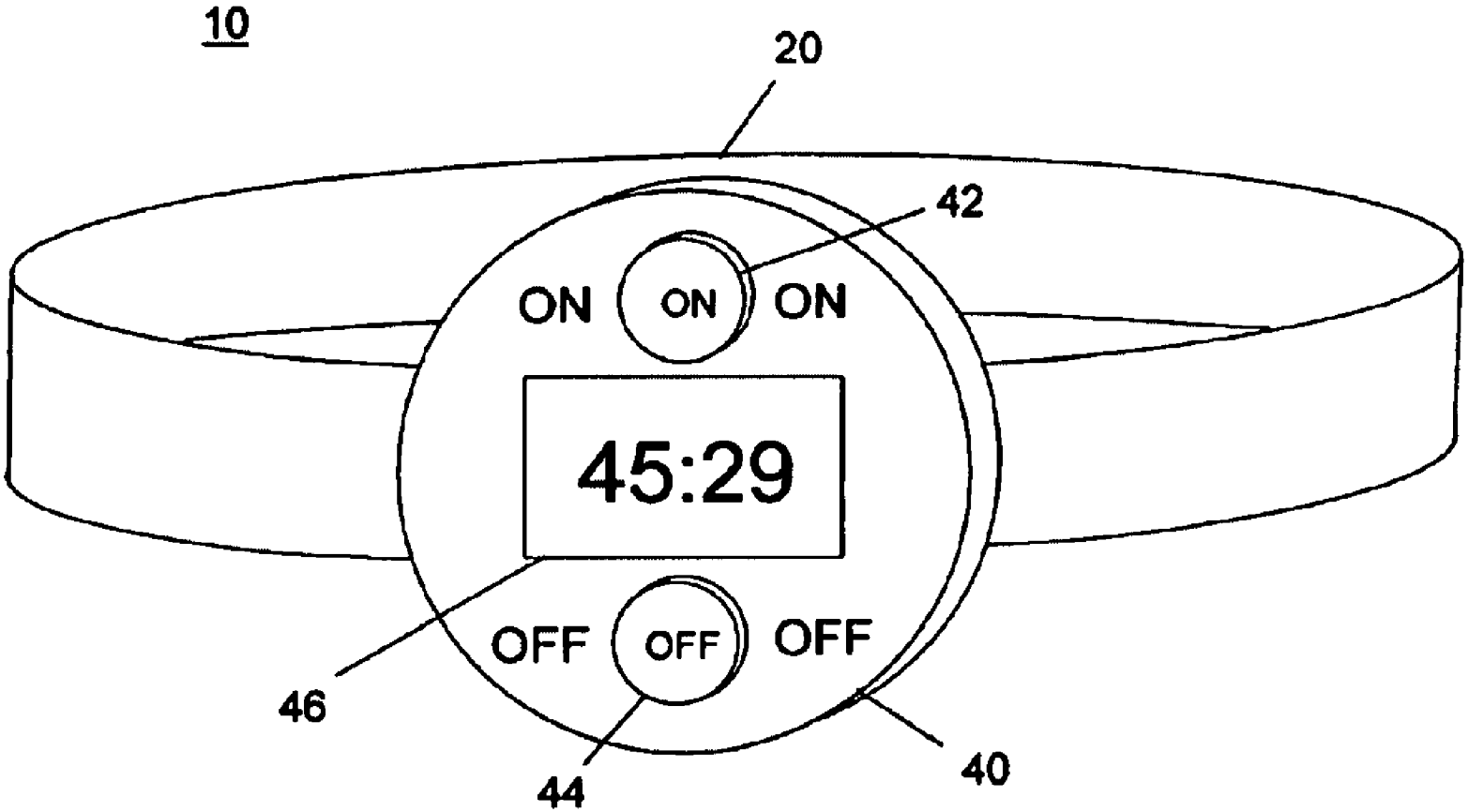
FIG. 1 is a perspective view of one embodiment of the present invention showing an electronic bottle timer and attachment band.

The preferred embodiment(s) of the present invention is illustrated in FIGS. 1–10. Turning to FIG. 1, a bottle timer 10 includes an adjustable band 20 and an electronic timer 40. Electronic timer 40 includes an "on" or "start" button 42, an "off" or "stop" button 44 and a changeable indicia 46. Changeable indicia 46 as shown is a digital display that is typically a liquid crystal display (LCD) or a light emitting diode display (LED). The LCD display is the preferred display since it requires less power to operate leading to prolonged battery life of the bottle timer 10. The electronic timer 40 preferably has a maximum elapsed time period of 120 minutes (2 hours) and, more preferably, of 60 minutes (1 hour). When a digital display is used, it may be either a count up or a count down timer. The elapsed time period is preferably a countdown time that corresponds to the useful life of the contents of a baby bottle once the contents are heated and used for feeding a baby. The contents may be formula, milk or other ingestible liquid. This useful life is generally believed to be between 1 to 2 hours by those of ordinary skill in the art and by those in the profession before the contents of the baby bottle become spoiled or potentially contaminated with airborne or other bacterial contaminants. Professional neonatal and pediatric professionals advocate the discarding of the contents of a baby bottle such as infant formula between 1–2 hours after a caregiver begins the use of a fresh or new baby bottle for feeding an infant. Although separate on-off buttons are illustrated, it is understood that the baby bottle timer may have a single on-off/start-end button to begin the countdown sequence and/or reset the timer.

Figure 3:
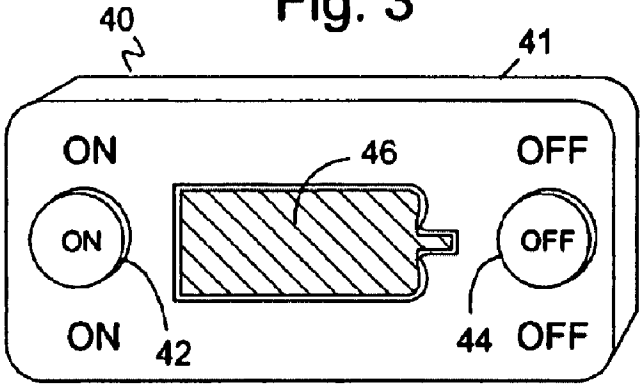
FIG. 3 is a perspective view of the embodiment shown in FIG. 2 of an electronic bottle timer showing indicia at the end of a usable time period of the contents of the baby bottle.
Figure 2:
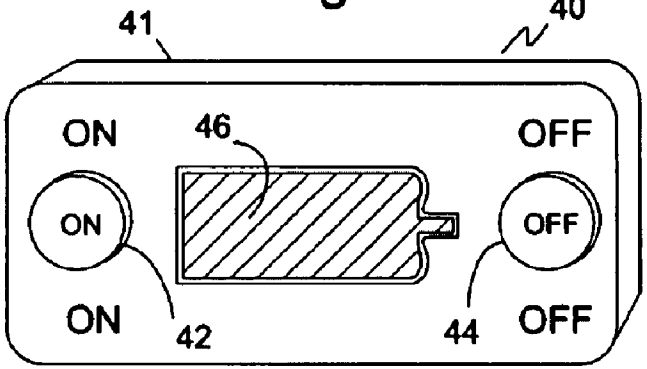
FIG. 2 is a perspective view of another embodiment of an electronic bottle timer showing indicia at the beginning of use of a baby bottle feeding time.

FIG. 2 illustrates another embodiment of the timer 40 of the present invention. In this embodiment, timer 40 displays indicia that change from an initial indicia to a different indicia such as, for example, a change in color from green to red. In this example, green indicates that the contents of the baby bottle are still safe to use while red indicates that the time period for safe use has expired and any remaining contents should be discarded. Timer 40 includes a timer housing 41, a timer display 46, and one or more on-off switches 42, 44. Timer display 46 is typically an LCD display that displays an indicia representing usable or "relatively fresh" contents within the baby bottle. The indicia may be a symbol, letters, colors, and the like, or any combination of indicia that provides the user with an indication of the freshness of the contents of the bottle. For example, the LCD may be a color LCD that changes color from green to red when the expiration time has passed. FIG. 3 illustrates the embodiment in FIG. 2 where the indicia is a change in color of the LCD (as represented by the diagonal lines) when the time period has expired.

It should be understood that the indicia used is not important but what is important is that a change occurs with the indicia to indicate the expiration of the "usable" time. For instance, a single LED lamp could indicate when the time has expired by either coming on at the end of the usable time or goes out at the end of the usable time or changes color. Switches 42, 44 may be any one of the variety of electronic switches available such as push-button, slide, toggle, two-way, three-way, membrane switches, etc.

Figure 4:
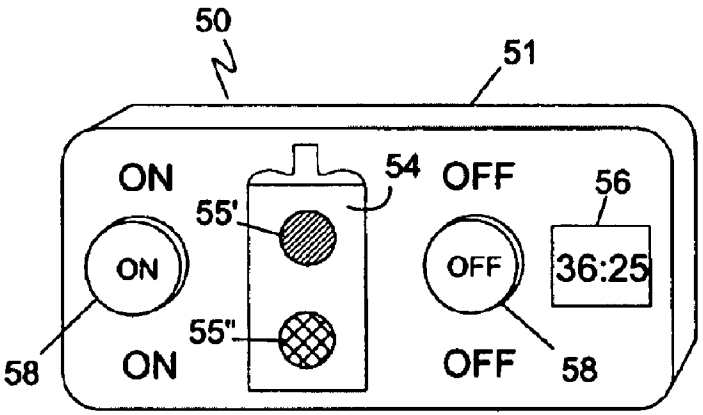
FIG. 4 is a perspective view of another embodiment of the timer of the present invention.

Turning now to FIG. 4, there is illustrated another embodiment of the present invention. The timer 50 includes a timer housing 51, a first timer display 54, a second timer display 56, and one or more timer switches 58. First timer display 54 has the shape of a baby bottle and includes a first indicia 55' and a second indicia 55". First indicia 55' and second indicia 55" indicate the status of the contents in the container to which it is attached by indicating the beginning of the timed period and the end of the timed period. For example, first indicia 55' may be illuminated or flashing to indicate that the timed period has started while second indicia 55" may become illuminated or flashing to indicate that the timed period has ended.

Second timer display 56 may be a digital display showing the remaining time within the time period, the time period being preferably two hours and more preferably one hour. The digital display may be either a count up or a count down timer. Second timer display 56 is enabled when the timer switch 58 used to begin the timed period is activated. Whether first timer display 54 is enabled when second timer display 56 is enabled depends on how timer 50 is configured. For instance, first timer display 54 may not be enabled until the preset time period of timer 50 has expired. As shown, one of the switches 58 enables timer 50 and begins the countdown of the preset time period while the other of the switches 58 turns off timer 50 and resets the preset time period. Optionally, the "off" switch may serve multiple purposes such as stopping the timing function when the bottle contents are placed into a preserving environment such as a refrigerator and/or resetting the time to the beginning of the preset time period. In the case where the contents are placed back into a preserving environment, the "on" switch when activated would continue the countdown from the previous time point. No matter how timer 50 is configured, first timer display 54 and second timer display 56 work in conjunction with each other to reinforce the time periods when the contents, i.e. milk, formula or other ingestible liquid, are either safe or unsafe to use.

Figure 5:
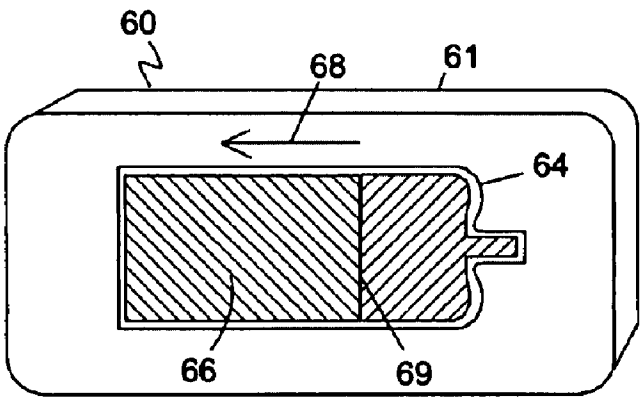
FIG. 5 is a perspective view of another embodiment of the present invention showing a mechanical bottle timer.

Turning now to FIG. 5, there is illustrated a mechanical timer 60. Mechanical timer 60 includes a timer housing 61 and a timer display 64. Timer display 64 incorporates a colored strip or band 66 that moves across timer display 64 as the preset time period runs down as indicated by arrow 68. Mechanical timer 60 typically includes a wind-up spring (not shown) that moves colored strip or band 66 from a start position showing only one color to a final position showing a different color. The boundary 69 between the two colors is typically seen moving across timer display 64 as the timed period runs down to zero.

Figure 7:
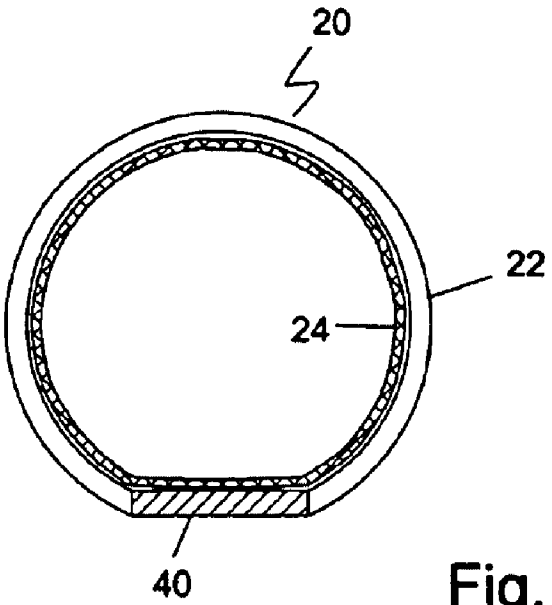
FIG. 7 is a top view of another embodiment of the present invention showing a two component timer band having an outer circumferential band and an inner, flexible resilient band.
Figure 6:
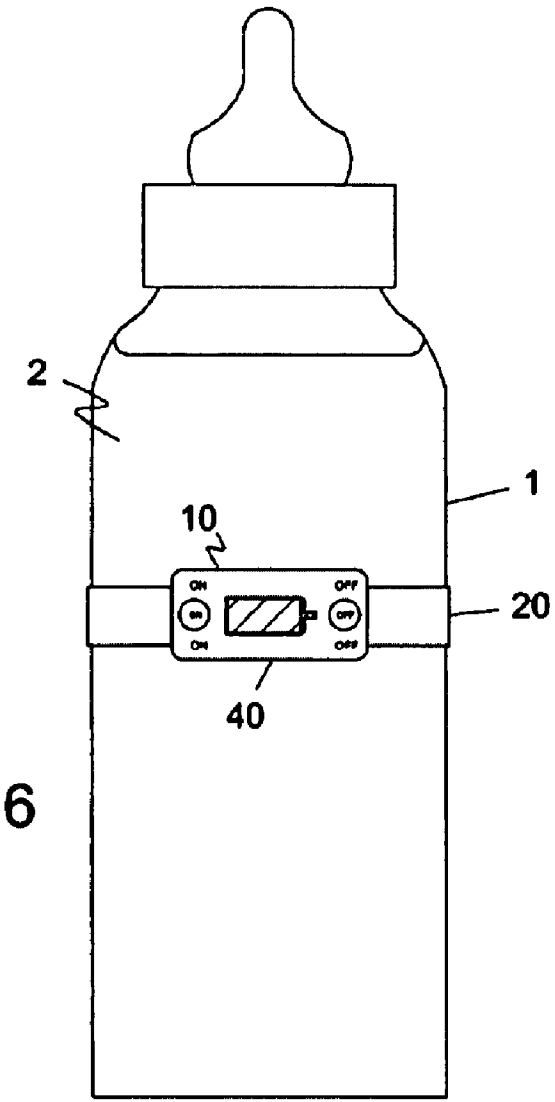
FIG. 6 is a front view of a bottle timer attached to an adjustable type band encircling a baby bottle.

FIG. 6 shows the combination of a container such as a baby bottle 1 filled with baby formula 2 and the bottle timer 10 of the present invention. Bottle timer 10 is slipped or fastened around container 1. Adjustable band 20 holds electronic timer 40 of bottle timer 10 in a temporary, stationary position while the bottle is being used. As previously discussed, adjustable band 20 may have various configurations including, but not limited to, hook and loop fastener bands, plastic slide band, elastic or stretchable band, clasp bands, and the like. FIG. 7 illustrates one embodiment of adjustable band 20. In this embodiment, adjustable band 20 includes an outer band 22 and an inner band 24. Outer band 22 may be a relatively rigid plastic band while inner band 24 is a flexible and/or resilient band. Inner band 24 is configured to hold timer 10 around the baby bottle.

Figure 9A:
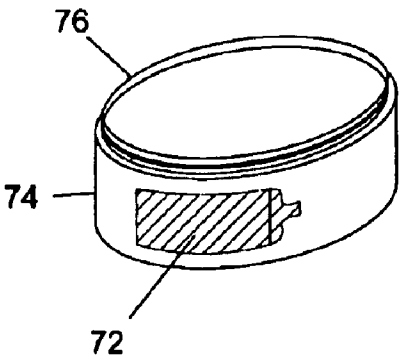
FIG. 9A is a top perspective view of the embodiment of the present invention illustrated in FIG. 8.
Figure 8:
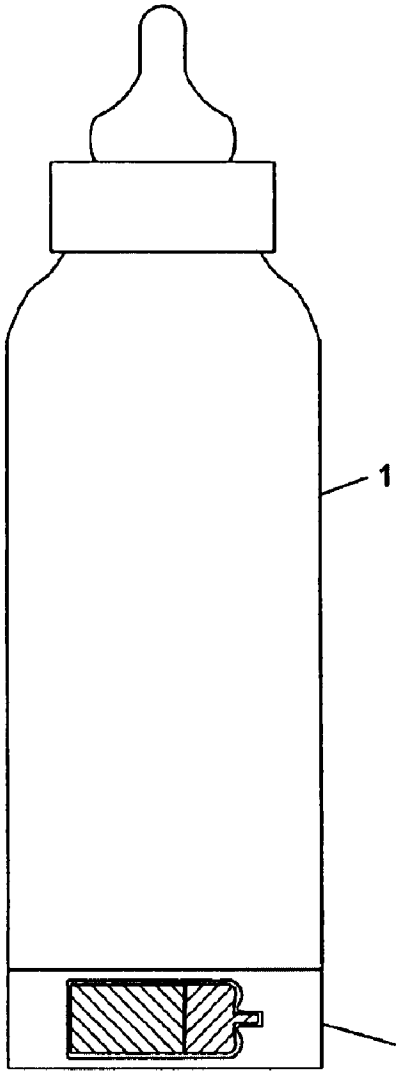
FIG. 8 is a front view of another embodiment of the present invention showing a baby bottle timer incorporated into a bottle attachment.

Bottle time 10 is not limited to attachment around the outside of bottle 1. In another embodiment of bottle timer 10, FIG. 8 illustrates a bottle timer 70 that is removably attached to the bottom of a baby bottle 1. In this particular embodiment, a mechanical timer 70 is illustrated having a timer display 72 similar to the timer display shown in FIG. 5. FIG. 9A shows a perspective view of mechanical timer 70 shown in FIG. 8. Mechanical timer 70 includes a housing 74 for containing the mechanical parts (not shown) such as a wind-up spring, the display strip and a winding component. The top of mechanical timer 70 includes an attachment mechanism such as a circumferential lip 76 that attaches to the bottom of bottle 1 using a frictional fit to a bottom recess in bottle 1. Circumferential lip 76 may also be configured for a frictional fit around the outside of the bottom of bottle 1.

Figure 9B:
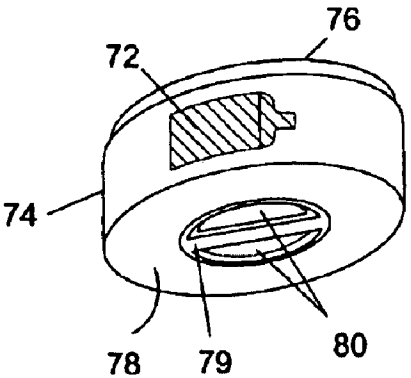
FIG. 9B is a bottom perspective view of the embodiment of the present invention illustrated in FIG. 8.

FIG. 9B is a perspective view of the bottom of mechanical timer 70. The bottom surface 78 of mechanical timer 70 includes a winding component 79. Winding component 79 includes optional recessed portions 80 to facilitate winding up of the mechanical timer 70. Like the electronic version of the present invention, mechanical timer 70 is configured to have a preset time period when fully wound up. The preset time period is preferably two hours or less, and, more preferably, one hour.

Figure 10:
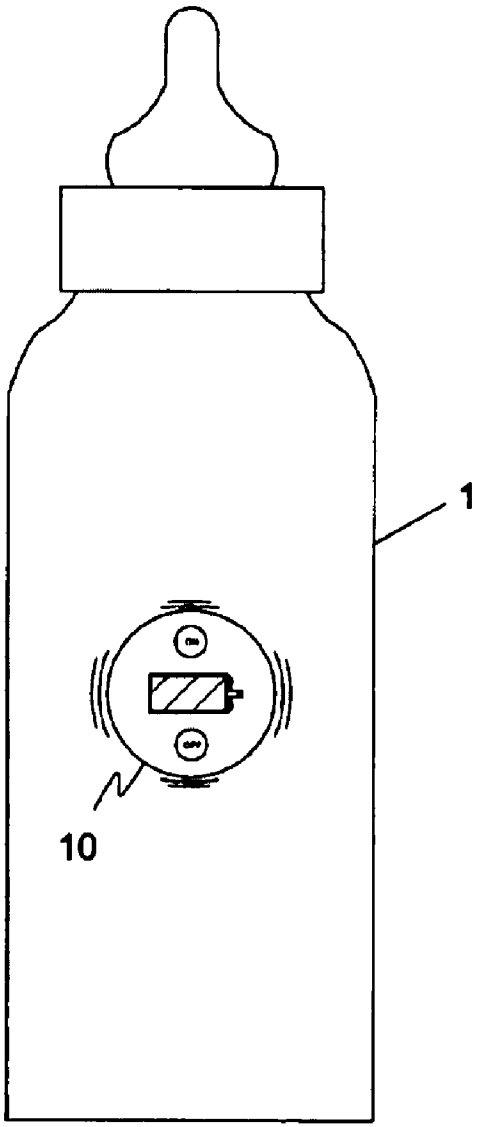
FIG. 10 is a front view of another embodiment of the present invention showing a baby bottle timer incorporated into a baby bottle.

It should be understood that the bottle timer housing may also be integrally formed as part of bottle 1 as illustrated, for example, in FIG. 10. This configuration, however, may be less desirable for electronic type timers since the electronics may be exposed to temperature extremes, microwave signals, water, etc., during use and re-use. Exposure to these various environmental conditions may shorten the usable life of the bottle time.

Use of the bottle timer 10 is relatively simple. A user attaches the bottle timer 10 to a baby bottle 1 containing fresh formula, milk or other ingestible fluid that is about to be used to feed a baby. The bottle may also be a bottle of formula or milk that was stored in a refrigerator. When the bottle is exposed to room temperature (preferably after heating and not before), the user would activate the "on" or "start" button/switch 42 on the bottle timer 10. Activating the on/start switch 42 enables the timer display 46. The timer display 46 indicates the formula/milk is safe to use. Once enabled, the timer display 46 continues to run until the preset time period is reached. The timer display 46 may be a digital display that displays 60 to 0 minutes or 120 to 0 minutes, or it may be a digital display that works in conjunction with colored indicia such as LCDs or LEDs to reinforce the time periods when the formula/milk is either safe or unsafe to use, or it may be a display that only displays indicia such as symbols, colors, and the like. If a digital display is used, the digital display may either count up or down. The timer display will continue to count down and then display the expired indicia until the bottle timer 10 is reset by the user. This typically occurs when either a separate switch is enabled or the on/start switch is disabled. The bottle timer 10 of the present invention allows the user to easily know if the contents of a bottle such as a formula, milk or other ingestible fluid are safe for use.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A baby bottle timer for use with a baby bottle containing stored breast milk, formula or other ingestible liquid, said baby bottle timer comprising:

a timer configured to have a maximum time period of only two hours to indicate exposure of said baby bottle containing stored breast milk, formula or other ingestible liquid to ambient air at room temperature or higher or to a bacterial source at room temperature or higher, said timer having a switch mechanism and a display with changeable indicia displaying an initial indicia at the beginning of said time period and a different indicia at the end of said time period; and an adjustable band attached to said timer and configured to removably attach said baby bottle timer to said baby bottle.

2. The baby bottle timer of claim 1 wherein said changeable indicia is a digital display.

3. The baby bottle timer of claim 1 wherein said changeable indicia are different colors.

4. The baby bottle timer of claim 1 wherein said timer is configured to have a maximum one-hour time period.

5. The baby bottle timer of claim 1 wherein said switch mechanism includes an on switch and an off switch.

6. The baby bottle timer of claim 1 wherein said timer is powered by a power source selected from the group consisting of mechanical, electrical and solar.

7. The baby bottle timer of claim 1 wherein said adjustable band is a flexible.

8. The baby bottle timer of claim 1 wherein said adjustable band is stretchable.

9. The baby bottle timer of claim 1 wherein said adjustable band has an outer, substantially rigid band and an inner flexible band.

10. In combination, a baby bottle and a baby bottle timer, said combination comprising:

a baby bottle wherein said baby bottle contains stored breast milk, formula, or other ingestible liquid; and a baby bottle timer connected to said baby bottle, said baby bottle timer having a maximum time period of only two-hours to be operable when said baby bottle is exposed to ambient air at room temperature or higher, or to a bacterial source at room temperature or higher, a switch mechanism and indicia to indicate the beginning and the end of said maximum two-hour time period.

11. The combination of claim 10 wherein said baby bottle timer has an adjustable band capable of removably attaching said baby bottle timer to said baby bottle.

12. The combination of claim 11 wherein said adjustable band is flexible.

13. The combination of claim 11 wherein said adjustable band is stretchable.

14. The combination of claim 10 wherein said baby bottle timer has a housing configured to attach to a base of said baby bottle.

15. The combination of claim 10 wherein said indicia displays a first color at the beginning of said maximum two-hour time period and a second color at the end of said maximum two-hour time period.

16. The combination of claim 10 wherein said indicia is one or more LED components.

17. The combination of claim 10 wherein said baby bottle timer is powered by a power source selected from the group consisting of mechanical, electrical and solar.

18. A method for indicating the usable condition of formula, milk or other ingestible fluid in a baby bottle, said method comprising:

initiating a baby bottle timer configured to operate for a maximum time period of only two hours when said baby bottle containing said formula, milk or other ingestible fluid is initially exposed to ambient air at room temperature or higher or to a bacterial source at room temperature or higher, said baby bottle timer being attached to said baby bottle; and using said baby bottle until an indicia on said baby bottle timer indicates the end of said maximum time period of only two hours.

19. The method of claim 18 further comprising removably attaching said baby bottle timer to said baby bottle.

20. The method of claim 18 further comprising re-setting said maximum two-hour time period of said baby bottle timer.

* * * * *